US005787601A

United States Patent [19]

Stelly

[11] Patent Number: 5,787,601

[45] Date of Patent: Aug. 4, 1998

[54] PORTABLE HAIR DRYER SYSTEM WITH RECHARGEABLE BATTERY PACK

[76] Inventor: Christina Stelly, 169 Barnes Ct., Gretna, La. 70056

[21] Appl. No.: 935,180

[22] Filed: Sep. 22, 1997

[51] Int. Cl.[6] ..... A45D 20/24

[52] U.S. Cl. ..... 34/99; 34/101; 34/283; 392/383

[58] Field of Search ..... 34/97, 99, 101, 34/283, 91; 392/380, 383

[56] References Cited

U.S. PATENT DOCUMENTS

| | | | |
|---|---|---|---|
| 2,466,915 | 4/1949 | Shields | 34/99 |
| 2,900,739 | 8/1959 | Tofield | 34/99 |
| 3,386,184 | 6/1968 | Ponczek | 34/99 |
| 3,946,498 | 3/1976 | Waters et al. | 34/99 |
| 5,651,190 | 7/1997 | Sanders | 34/99 |

*Primary Examiner*—Henry A. Bennett
*Assistant Examiner*—Pamela A. Wilson
*Attorney, Agent, or Firm*—Joseph N. Breaux

[57] ABSTRACT

A hair dryer system that includes a rechargeable battery pack for supplying electrical power to both the air heating element and the blower fan; that includes an air filter holder for holding a replaceable air filter that can be replaced when clogged by lint and other airborne contaminants; and that includes a hair bonnet positionable over a user's head and an adjustable waist strap for securing a dryer housing containing the air heating element and the blower fan about the waist of the user.

16 Claims, 3 Drawing Sheets

PORTABLE HAIR DRYER SYSTEM WITH RECHARGEABLE BATTERY PACK

TECHNICAL FIELD

The present invention relates to hair dryers and more particularly to a self-contained hair dryer system that includes a dryer housing having a replaceable air intake filter holder, a battery pack receiving cavity formed into an outer surface thereof that is partially defined by an angled contact face having two dryer system contact pads provided thereon, a hair bonnet and air supply hose compartment that is sealable with a hair bonnet and air supply hose storage compartment cover, a dryer system component chamber formed therein, an adjustable length waist strap assembly, an on/off switch in electrical connection with one of the two dryer system contact pads, an air supply hose air supply fitting, and a blower fan speed control knob; at least one replaceable air intake filter that is positionable into the replaceable air intake filter holder through a filter insertion opening provided into the replaceable air intake filter holder; a hair bonnet in air flow connection with an air supply hose having a fitting connecting end that is frictionally securable over the air supply hose air supply fitting of the dryer housing; a battery pack having an angled battery contact face provided with two battery contact pads spaced for connection with the two dryer system contact pads when the battery pack is inserted into the battery pack receiving cavity of the dryer housing; a blower fan assembly including an electric motor and having an air intake side in air flow connection with the air intake filter holder; a nickel cadmium (NiCad) wire air heating unit connected in air flow connection with the blower discharge end of the blower fan assembly; a heated air conduit in air flow connection between a heated air discharge of the air heating unit and the air supply hose air supply fitting; and a variable resistance blower fan speed controller having an actuator in mechanical connection with the speed control knob of the dryer housing and a variable resistance element in electrical connection with the electric motor of the blower fan assembly.

BACKGROUND OF THE INVENTION

Many hair styles benefit from artificial drying from a hair dryer that provides heated air onto the hair. Because hair dryers typically require an outside electrical power source to power the heating element and blower fan, use of a hair dryer can restrict movement of the person to an area defined by the length of the electrical power cord. It would be a benefit, therefore, to have a hair dryer system that included a rechargeable battery pack for supplying electrical power to both the air heating element and the blower fan. Because many hair dryers are damaged each year from overheating caused by a clogged air intake, it would be a further benefit to have a hair dryer system that included an air filter holder for holding a replaceable air filter that can be easily replaced when clogged by lint and other airborne contaminants. In addition, to further enhance mobility while using the hair dryer, it would be a further benefit to have a hair dryer system that included a hair bonnet positionable over a user's head and an adjustable waist strap for securing a dryer housing containing the air heating element and the blower fan so as to free the hands of the user for other activities.

SUMMARY OF THE INVENTION

It is thus an object of the invention to provide a hair dryer system.

It is a further object of the invention to provide a hair dryer system that includes a rechargeable battery pack for supplying electrical power to both the air heating element and the blower fan.

It is a still further object of the invention to provide a hair dryer system that includes an air filter holder for holding a replaceable air filter that can be replaced when clogged by lint and other airborne contaminants.

It is a still further object of the invention to provide a hair dryer system that includes a hair bonnet positionable over a user's head and an adjustable waist strap for securing a dryer housing containing the air heating element and the blower fan about the waist of the user.

It is a still further object of the invention to provide a hair dryer system that includes a dryer housing having a replaceable air intake filter holder, a battery pack receiving cavity formed into an outer surface thereof that is partially defined by an angled contact face having two dryer system contact pads provided thereon, a hair bonnet and air supply hose compartment that is sealable with a hair bonnet and air supply hose storage compartment cover, a dryer system component chamber formed therein, an adjustable length waist strap assembly, an on/off switch in electrical connection with one of the two dryer system contact pads, an air supply hose air supply fitting, and a blower fan speed control knob; at least one replaceable air intake filter that is positionable into the replaceable air intake filter holder through a filter insertion opening provided into the replaceable air intake filter holder; a hair bonnet in air flow connection with an air supply hose having a fitting connecting end that is frictionally securable over the air supply hose air supply fitting of the dryer housing; a battery pack having an angled battery contact face provided with two battery contact pads spaced for connection with the two dryer system contact pads when the battery pack is inserted into the battery pack receiving cavity of the dryer housing; a blower fan assembly including an electric motor and having an air intake side in air flow connection with the air intake filter holder; a nickel cadmium (NiCad) wire air heating unit connected in air flow connection with the blower discharge end of the blower fan assembly; a heated air conduit in air flow connection between a heated air discharge of the air heating unit and the air supply hose air supply fitting; and a variable resistance blower fan speed controller having an actuator in mechanical connection with the speed control knob of the dryer housing and a variable resistance element in electrical connection with the electric motor of the blower fan assembly.

It is a still further object of the invention to provide a hair dryer system that accomplishes some or all of the above objects in combination.

Accordingly, a hair dryer system is provided. The hair dryer system includes a dryer housing having a replaceable air intake filter holder, a battery pack receiving cavity formed into an outer surface thereof that is partially defined by an angled contact face having two dryer system contact pads provided thereon, a hair bonnet and air supply hose compartment that is sealable with a hair bonnet and air supply hose storage compartment cover, a dryer system component chamber formed therein, an adjustable length waist strap assembly, an on/off switch in electrical connection with one of the two dryer system contact pads, an air supply hose air supply fitting, and a blower fan speed control knob; at least one replaceable air intake filter that is positionable into the replaceable air intake filter holder through a filter insertion opening provided into the replaceable air intake filter holder; a hair bonnet in air flow connection with an air supply hose having a fitting connecting end that is frictionally securable over the air supply hose air supply fitting of the dryer housing; a battery pack having an angled battery contact face provided with two battery contact pads spaced for connection with the two dryer system contact pads when the battery pack is inserted into the battery pack receiving cavity of the dryer housing; a blower fan assembly including an electric motor and having an air intake side in air flow connection with the air intake filter holder; a nickel cadmium (NiCad) wire air heating unit connected in air flow connection with the blower discharge end of the blower fan assembly; a heated air conduit in air flow connection between a heated air discharge of the air heating unit and the air supply hose air supply fitting; and a variable resistance blower fan speed controller having an actuator in mechanical connection with the speed control knob of the dryer housing and a variable resistance element in electrical connection with the electric motor of the blower fan assembly.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
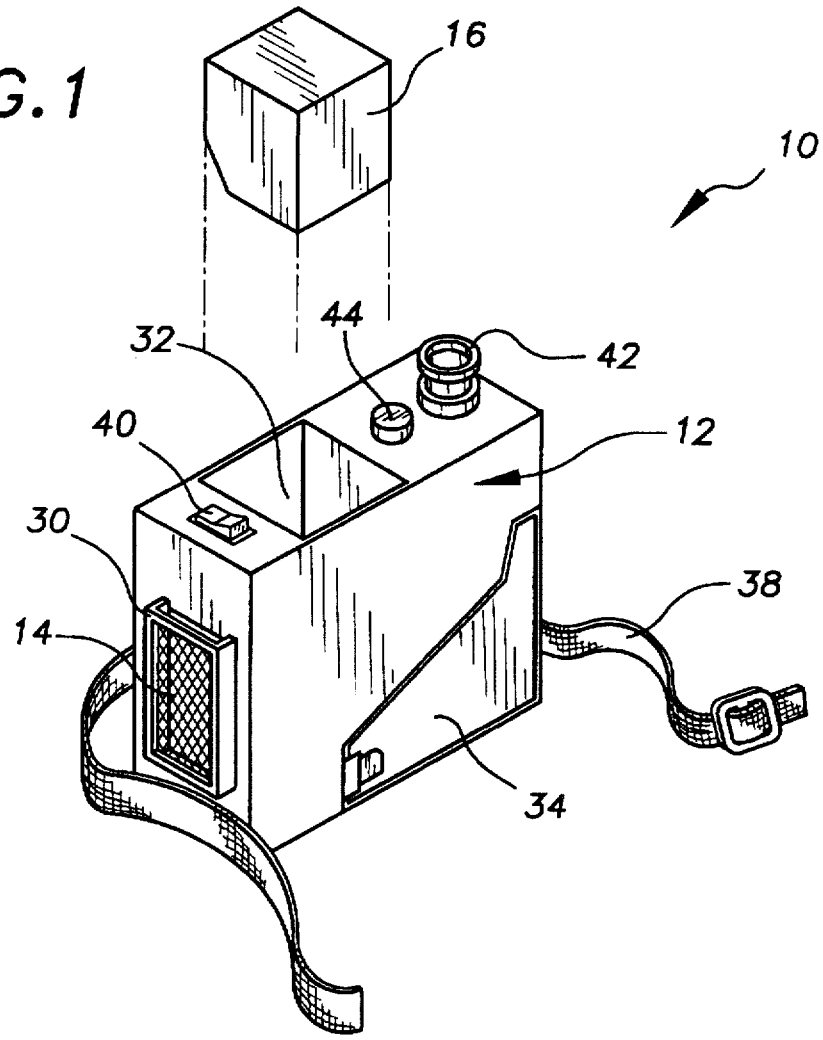
FIG. 1 is a partially exploded perspective view of an exemplary embodiment of the hair dryer system of the present invention showing the dryer housing showing the replaceable air intake filter holder with a replaceable air intake filter positioned therein, the rechargeable battery pack exploded out of the battery pack receiving cavity, the hair bonnet and air supply hose storage compartment cover snapped in place over the opening to the hair bonnet and air supply hose compartment, the adjustable waist strap assembly, the on/off switch, the air supply hose air supply fitting, and the blower fan speed control knob.

FIG. 1 shows an exemplary embodiment of the hair dryer system of the present invention generally designated by the numeral 10. In this embodiment, hair dryer system 10 includes a dryer housing, generally designated 12; at least one replaceable air intake filter, generally designated 14; a battery pack, generally designated 16; with reference to FIG. 2, a hair bonnet, generally designated 18; an air supply hose, generally designated 20; a blower fan assembly, generally designated 22; a nickel cadmium (NiCad) wire air heating unit, generally designated 24; a heated air conduit, generally designated 26; and, with reference to FIG. 4, a variable resistance blower fan speed controller, generally designated 28.

With reference back to FIG. 1, dryer housing 10 is of molded plastic construction and includes a replaceable air intake filter holder 30 (more clearly shown in FIG. 3) formed on a side surface thereof; a battery pack receiving cavity 32 formed into the top surface thereof; a hair bonnet and air supply hose storage compartment cover 34 that snap fits over an opening into a hair bonnet and air supply hose compartment 36 (FIG. 2) formed within dryer housing 12; a woven nylon strapping adjustable waist strap assembly 38; an on/off switch 40; an air supply hose air supply fitting 42; and a blower fan speed control knob 44.

Figure 2:
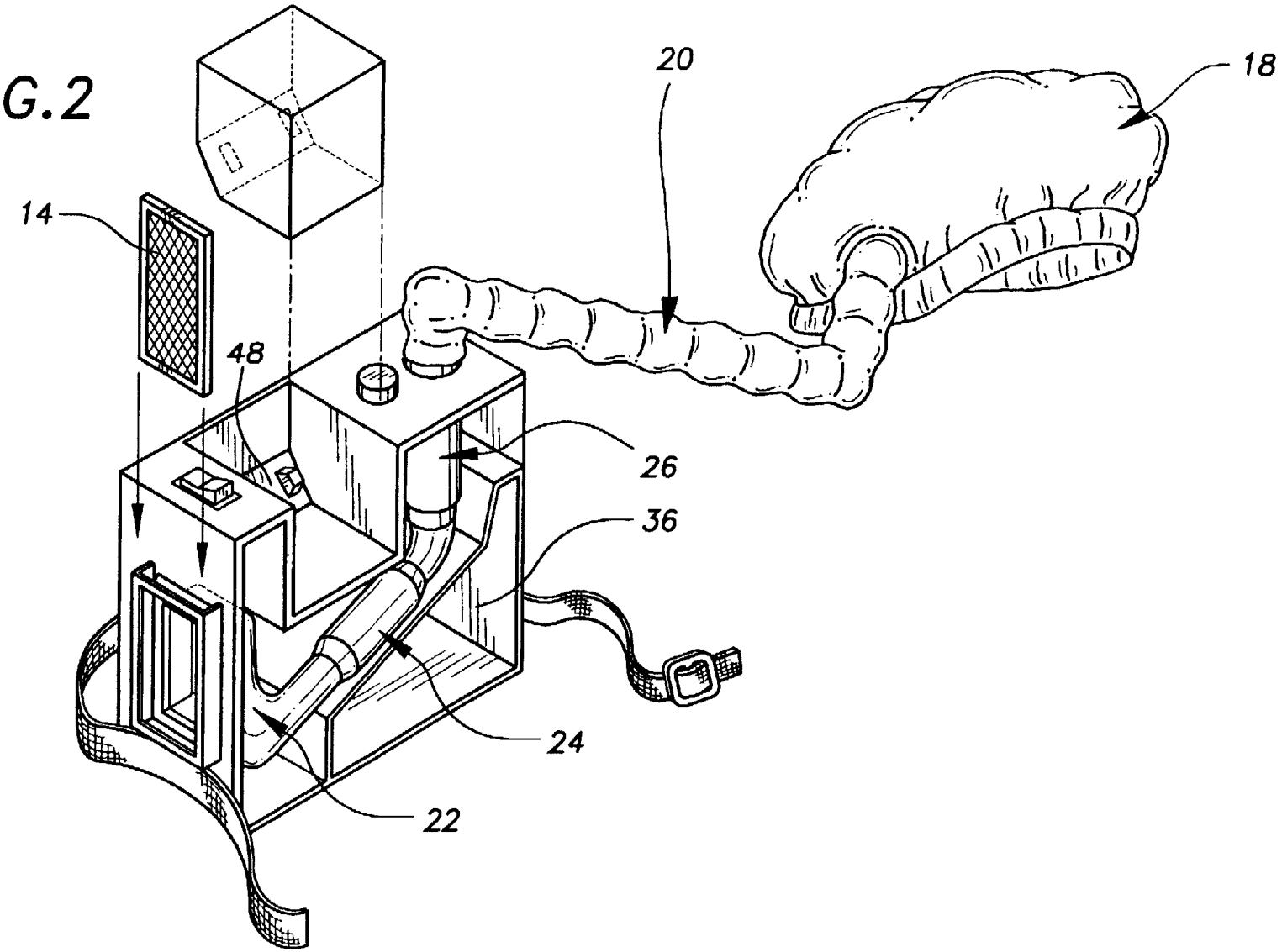
FIG. 2 is a partially exploded, front cutaway view of the exemplary hair dryer system of FIG. 1 with the nylon hair bonnet and the nylon air supply hose removed from the hair bonnet and air supply hose compartment and the air supply hose fit over the air supply hose air supply fitting; the replaceable air intake filter exploded out of the replaceable air intake filter holder; the rechargeable battery pack exploded out of the battery pack receiving cavity; the blower fan assembly with the intake side connected to the air intake filter holder; the nickel cadmium (NiCad) wire air heating unit connected to the discharge end of the blower fan assembly; and the heated air conduit connected between the heated air discharge of the air heating unit and the air supply hose air supply fitting.
Figure 2A:
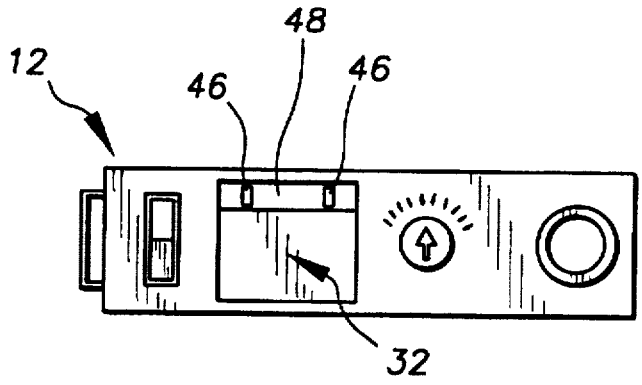
FIG. 2A is a top plan view of the dryer housing showing the two dryer system contact pads provided on the angled, interior defining wall contact face of the battery pack receiving cavity.
Figure 2B:
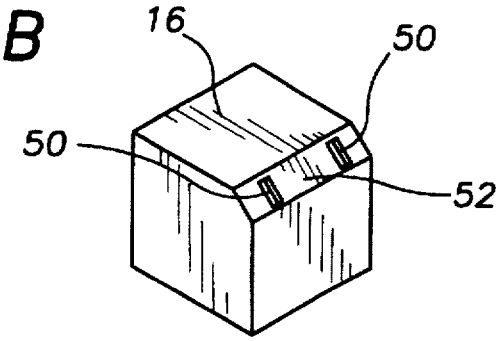
FIG. 2B is a perspective view of the battery pack in isolation showing the angled battery contact face with the two battery contact pads spaced for connection with the two dryer system contact pads when the battery pack is inserted into the battery pack receiving cavity.

With reference to FIG. 2A, dryer housing 12 also includes two copper, dryer system contact pads 46 that are provided on an angled, interior defining wall contact face 48 (also shown in FIG. 2) of battery pack receiving cavity 32. Dryer system contact pads 46 are spaced, with reference to FIG. 2B, to correspond with two battery contact pads 50 that are provided on an angled battery contact face 52 of battery pack 16. Angled battery contact face 52 and angled, interior defining wall contact face 48 (FIG. 2A) are used as a keying mechanism to prevent incorrect insertion of battery pack 16 into battery pack receiving cavity 32 (FIG. 2A).

Figure 3:
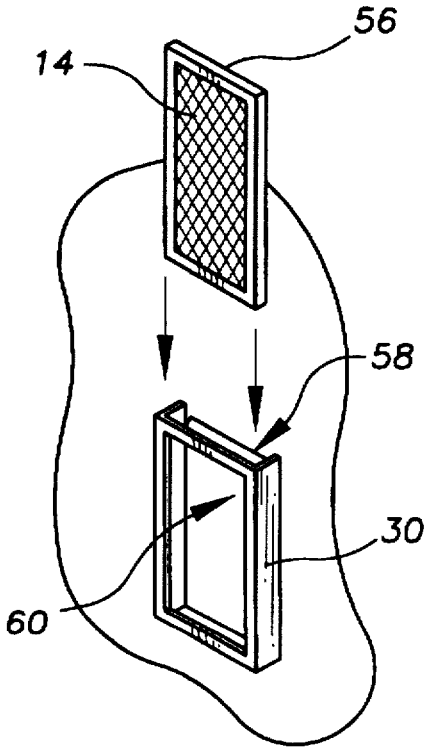
FIG. 3 is a detail perspective view of the replaceable air intake filter holder with the replaceable air intake filter positioned above the filter insertion opening and the air intake opening into the blower fan unit.

With reference to FIG. 3, in this embodiment, replaceable air intake filter 14 is a section of small diameter plastic screening held within a rectangular shaped metal frame 56. Frame 56 is inserted into replaceable air intake filter holder 30 through a filter insertion opening 58 and positioned in front of an air intake opening 60 of blower fan unit 22 (FIGS. 2,4).

Figure 4:
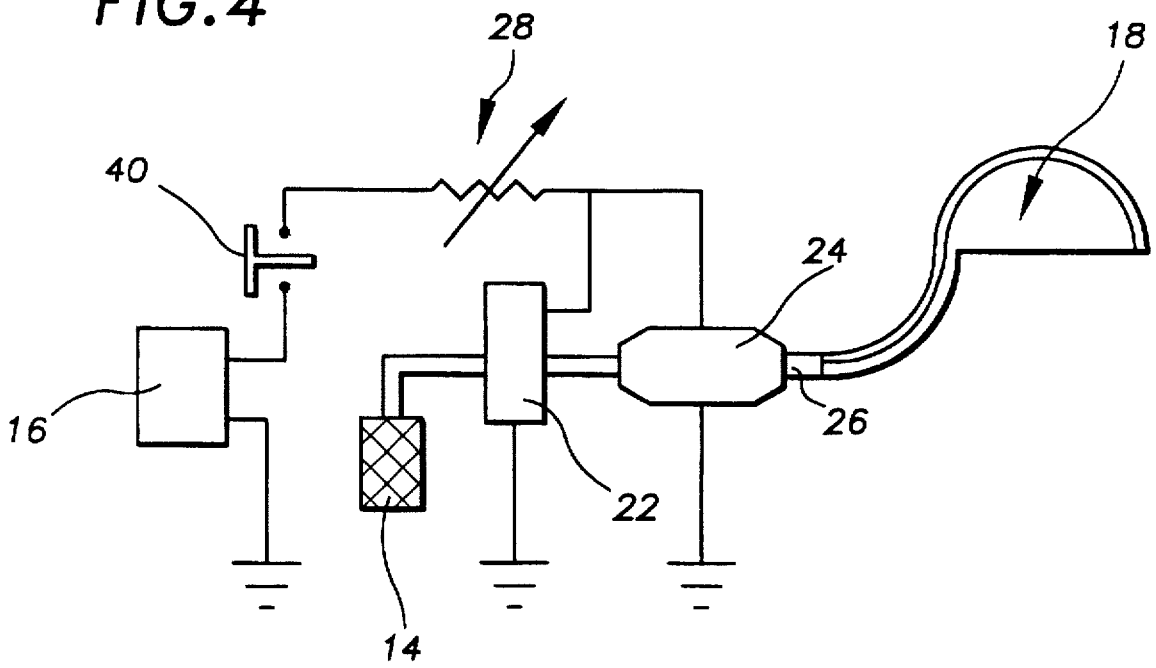
FIG. 4 is a schematic diagram showing the battery pack, the on/off switch, the blower fan speed control, the air intake filter opening, the blower far, the air heating unit, the heated air conduit, the air supply hose, and the hair bonnet.

With reference to FIG. 4, blower fan assembly 22 is a conventional DC powered blower fan unit; nickel cadmium (NiCad) wire air heating unit 24 is a conventional nickel cadmium (NiCad) wire air heating unit; on/off switch 40 is a conventional two position switch; and variable resistance blower fan speed controller 28 is a conventional variable resistance controller. In operation, blower fan assembly 22 and nickel cadmium (NiCad) wire air heating unit 24 are activated by positioning on/off switch 40 into the "on" position when battery pack 16 is inserted into battery pack receiving cavity 32 (FIG. 1). As blower fan assembly 22 operates, air is drawn in through replaceable filter 14, and discharged through nickel cadmium (NiCad) wire air heating unit 24 into hair bonnet 18.

It can be seen from the preceding description that a hair dryer system has been provided that includes a rechargeable battery pack for supplying electrical power to both the air heating element and the blower fan; that includes an air filter holder for holding a replaceable air filter that can be replaced when clogged by lint and other airborne contaminants; that includes a hair bonnet positionable over a user's head and an adjustable waist strap for securing a dryer housing containing the air heating element and the blower fan about the waist of the user; and that includes a dryer housing having a replaceable air intake filter holder, a battery pack receiving cavity formed into an outer surface thereof that is partially defined by an angled contact face having two dryer system contact pads provided thereon, a hair bonnet and air supply hose compartment that is sealable with a hair bonnet and air supply hose storage compartment cover, a dryer system component chamber formed therein, an adjustable length waist strap assembly, an on/off switch in electrical connection with one of the two dryer system contact pads, an air supply hose air supply fitting, and a blower fan speed control knob; at least one replaceable air intake filter that is positionable into the replaceable air intake filter holder through a filter insertion opening provided into the replaceable air intake filter holder; a hair bonnet in air flow connection with an air supply hose having a fitting connecting end that is frictionally securable over the air supply hose air supply fitting of the dryer housing; a battery pack having an angled battery contact face provided with two battery contact pads spaced for connection with the two dryer system contact pads when the battery pack is inserted into the battery pack receiving cavity of the dryer housing; a blower fan assembly including an electric motor and having an air intake side in air flow connection with the air intake filter holder; a nickel cadmium (NiCad) wire air heating unit connected in air flow connection with the blower discharge end of the blower fan assembly; a heated air conduit in air flow connection between a heated air discharge of the air heating unit and the air supply hose air supply fitting; and a variable resistance blower fan speed controller having an actuator in mechanical connection with the speed control knob of the dryer housing and a variable resistance element in electrical connection with the electric motor of the blower fan assembly.

It is noted that the embodiment of the hair dryer system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A hair dryer system comprising:

a dryer housing having a replaceable air intake filter holder, a battery pack receiving cavity formed into an outer surface thereof that is partially defined by an angled contact face having two dryer system contact pads provided thereon, a hair bonnet and air supply hose compartment that is sealable with a hair bonnet and air supply hose storage compartment cover, a dryer system component chamber formed therein, an on/off switch in electrical connection with one of said two dryer system contact pads, an air supply hose air supply fitting, and a blower fan speed control knob;

at least one replaceable air intake filter that is positionable into said replaceable air intake filter holder through a filter insertion opening provided into said replaceable air intake filter holder;

a hair bonnet in air flow connection with an air supply hose having a fitting connecting end that is frictionally securable over said air supply hose air supply fitting of said dryer housing;

a rechargeable battery pack having an angled battery contact face provided with two battery contact pads spaced for connection with said two dryer system contact pads when said battery pack is inserted into said battery pack receiving cavity of said dryer housing;

a blower fan assembly including an electric motor and having an air intake side in air flow connection with said air intake filter holder;

an air heating unit connected in air flow connection with said blower discharge end of said blower fan assembly;

a heated air conduit in air flow connection between a heated air discharge of said air heating unit and said air supply hose air supply fitting; and a blower fan speed controller having an actuator in mechanical connection with said speed control knob of said dryer housing and a controller element in electrical connection with said electric motor of said blower fan assembly.

2. The hair dryer system of claim 1, wherein:

said hair bonnet is constructed of a nylon film.

3. The hair dryer system of claim 2, wherein:

said air heating unit is a nickel cadmium (NiCad) wire air heating unit.

4. The hair dryer system of claim 3 wherein:

said blower fan speed controller includes a variable resistance controller element.

5. The hair dryer system of claim 3 wherein:

said dryer housing further includes an adjustable length waist strap assembly.

6. The hair dryer system of claim 4, wherein:

said dryer housing further includes an adjustable length waist strap assembly.

7. The hair dryer system of claim 2 wherein:

said blower fan speed controller includes a variable resistance controller element.

8. The hair dryer system of claim 7 wherein:

said dryer housing further includes an adjustable length waist strap assembly.

9. The hair dryer system of claim 2 wherein:

said dryer housing further includes an adjustable length waist strap assembly.

10. The hair dryer system of claim 1, wherein:

said air heating unit is a nickel cadmium (NiCad) wire air heating unit.

11. The hair dryer system of claim 10 wherein:

said blower fan speed controller includes a variable resistance controller element.

12. The hair dryer system of claim 10 wherein:

said dryer housing further includes an adjustable length waist strap assembly.

13. The hair dryer system of claim 11, wherein:

said dryer housing further includes an adjustable length waist strap assembly.

14. The hair dryer system of claim 1 wherein:

said blower fan speed controller includes a variable resistance controller element.

15. The hair dryer system of claim 14 wherein:

said dryer housing further includes an adjustable length waist strap assembly.

16. The hair dryer system of claim 1 wherein:

said dryer housing further includes an adjustable length waist strap assembly.

* * * * *